US006745842B2

(12) United States Patent
Hughes et al.

(10) Patent No.: US 6,745,842 B2
(45) Date of Patent: Jun. 8, 2004

(54) CONCENTRIC CASING JACK

(75) Inventors: William James Hughes, Tulsa, OK (US); Mark Edward Dunbar, Tulsa, OK (US)

(73) Assignee: Sunstone Corporatioin, Oklahoma City, OK (US)

( * ) Notice: Subject to any disclaimer, the term of this patent is extended or adjusted under 35 U.S.C. 154(b) by 0 days.

(21) Appl. No.: 09/971,308

(22) Filed: Oct. 4, 2001

(65) Prior Publication Data

US 2003/0066656 A1 Apr. 10, 2003

(51) Int. Cl.[7] ..... E21B 19/00
(52) U.S. Cl. ..... 166/383; 166/77.1
(58) Field of Search ..... 166/77.1, 77.5, 166/171, 383, 78, 85, 378, 379; 175/22, 57, 171, 195, 202, 203

(56) References Cited

U.S. PATENT DOCUMENTS

| | | | | | |
|---|---|---|---|---|---|
| 4,067,062 | A | | 1/1978 | Baugh | 166/125 |
| 4,258,792 | A | | 3/1981 | Restarick | 166/315 |
| 4,421,175 | A | * | 12/1983 | Boyadjieff et al. | 166/383 |
| 4,479,547 | A | * | 10/1984 | Boyadjieff et al. | 166/383 |
| 4,595,062 | A | * | 6/1986 | Boyadjieff et al. | 166/379 |
| 4,745,969 | A | * | 5/1988 | Henderson | 166/68.5 |
| 4,902,044 | A | | 2/1990 | Williams et al. | 285/18 |
| 5,361,834 | A | * | 11/1994 | Cox | 166/120 |
| 5,488,992 | A | | 2/1996 | Pringle | 166/332.5 |
| 5,522,464 | A | | 6/1996 | Piper | 166/77.2 |
| 5,524,710 | A | | 6/1996 | Shinn | 166/348 |
| 5,944,111 | A | | 8/1999 | Bridges | 166/348 |
| 5,988,274 | A | | 11/1999 | Funk | 166/77.4 |
| 5,996,688 | A | * | 12/1999 | Schultz et al. | 166/72 |
| 6,009,941 | A | | 1/2000 | Haynes | 166/72 |
| 6,019,175 | A | | 2/2000 | Haynes | 166/382 |
| 6,035,938 | A | | 3/2000 | Watkins | 166/345 |

* cited by examiner

*Primary Examiner*—Frank Tsay
(74) *Attorney, Agent, or Firm*—Rudolf O. Siegesmund

(57) ABSTRACT

A concentric casing jack is disclosed having a casing supporter and actuator that uses hydraulic fluid to vertically raise and lower an inner concentric string of casing in a well. This casing jack is connected to a string of casing and can operate down-hole tools attached to the lower end of the casing by actuating the casing. The casing jack is supported at the surface by the wellhead and can be incorporated into a series of drilling spools and blowout preventer valves that are commonly utilized during drilling operations. The casing jack consists of a housing and a hollow piston whose internal diameter is similar in size to the concentric casing. The similar sizing allows drill bits and bottom hole assemblies to pass through the hollow center of the casing jack and the attached string of casing. The piston is equipped with external seals to hold hydraulic pressure between the hollow piston and the body of the jack. The lower shaft of the piston extends through the base of the casing jack housing where the lower shaft is threaded onto the concentric string of casing in the well bore. The upper shaft of the hollow piston extends above the top of the casing jack housing where it connects to the surface drilling equipment. The casing jack is equipped with two hydraulically retractable supports that fit into the recessed area of the hollow piston and support the weight of the casing and piston after the piston is in its raised position. The casing jack also contains an internal shoulder to support the piston and the casing when the piston is in the lowered position.

26 Claims, 5 Drawing Sheets

CONCENTRIC CASING JACK

FIELD OF THE INVENTION

The present invention is directed to oilfield tools and assemblies. Specifically, the invention relates to an apparatus and method for supporting and actuating a concentric casing string during drilling operations.

BACKGROUND

It is often useful to utilize a second string of casing, tubing, or dill pipe inside the production casing when drilling for oil, gas, or water. Frequently, the inner string of concentric casing is supported from the surface and the drill string is inserted inside the inner string of casing. The drill string may then be operated independently of the inner string of casing. Additionally, it is often desirable to be able to vertically actuate the inner casing so that a tool attached to the lower end of the inner casing may be operated. An apparatus that supports the inner casing string from the surface and is able to actuate the inner casing string along its vertical axis is known as a casing jack.

The prior art has frequently addressed the subject of supporting an inner string of casing or tubing within the well bore. U.S. Pat. No. 6,019,175 (the '175 patent) discloses an apparatus and method for hanging a tubing string within a well bore and permitting vertical displacement of the tubing string without removal of the wellhead. However, the '175 patent is limited in that it does not disclose a method or apparatus for vertically actuating the tubing string to operate down hole tools.

U.S. Pat. No. 6,009,941 (the '941 patent) discloses an apparatus for supporting and vertically displacing a down-hole tool or a tubing string. However, the '941 patent is limited in that it discloses a complicated apparatus that is difficult to install and operate in the field. A need exist beyond the '941 patent for an apparatus and method of supporting and vertically displacing a tubing or casing string that is simple to install and operate.

What is needed beyond the prior art is an apparatus and method for supporting tubing or casing that is also capable of vertically actuating the tubing or casing during drilling operations. Additionally, a need exists beyond the prior art for a casing jack that is simple to install and can be operated independently of a drill string.

SUMMARY OF THE INVENTION

The present invention, which meets the needs stated above, is a concentric casing jack having a casing supporter and actuator that uses hydraulic fluid to vertically raise and lower an inner concentric string of casing in a well. The concentric casing jack is connected to a string of casing and can operate down-hole tools attached to the lower end of the casing by actuating the casing. The casing jack is supported at the surface by the wellhead and can be incorporated into a series of drilling spools and blowout preventer valves that are commonly utilized during drilling operations. The concentric casing jack consists of a housing and a piston whose internal diameter is similar in size to the concentric casing. The similar sizing allows drill bits and bottom hole assemblies to pass through the hollow center of the casing jack and the attached string of casing. The piston is equipped with external seals to hold hydraulic pressure between the hollow piston and the body of the jack. The lower shaft of the piston extends through the base of the casing jack housing where the lower shaft is threaded onto the concentric string of casing in the well bore. The upper shaft of the piston extends above the top of the casing jack housing where it connects to the surface drilling equipment. The casing jack is equipped with two hydraulicaly retractable support plates that fit into recessed areas of the piston and support the weight of the casing and piston after the piston is in its raised position. The casing jack also contains an internal shoulder to support the piston and the casing when the piston is in the lowered position.

DETAILED DESCRIPTION OF PREFERRED EMBODIMENT

Figure 1:
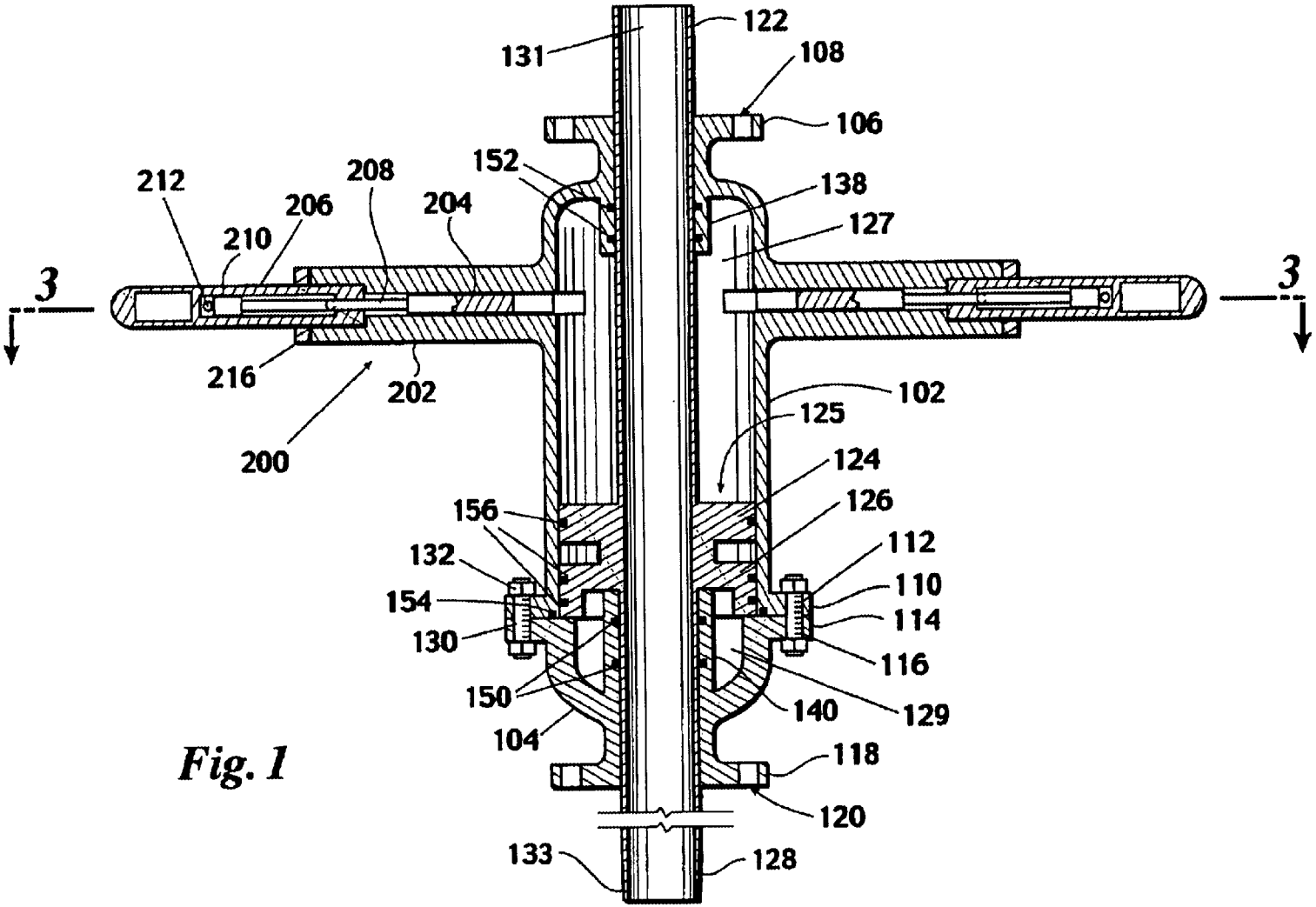
FIG. 1 is a cross-section of the Concentric Casing Jack taken along line 1—1 in FIG. 6 showing the piston in the lowered position and the support plates in the recessed position.
Figure 6:
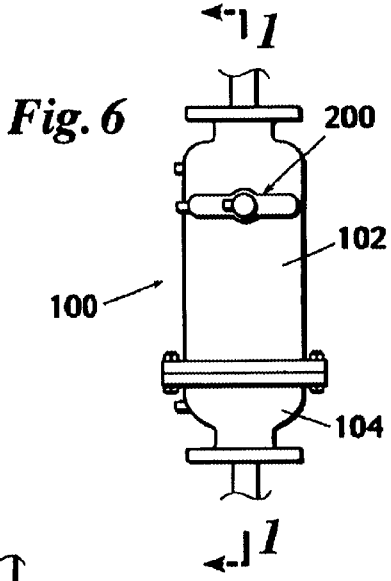
FIG. 6 is a side view of the exterior of the Concentric Casing Jack.

FIG. 1 is a cross-section of Concentric Casing Jack (CCJ) 100 along line 1—1 of the side view of CCJ 100 shown in FIG. 6. CCJ 100 consists of upper housing 102, lower housing 104, and piston assembly 125. Upper housing 102 has top flange 106 for removable engagement with a drilling spool such as drilling spool 12 (see FIG. 8). Bolts 130 (not shown) are inserted through top flange bolt holes 108 and secured with nuts 132 (not shown) to attach top flange 106 to drilling spool 12. Upper housing 102 connects to lower housing 104 by engaging upper housing main flange 110 to lower housing main flange 114 by inserting bolts 130 through upper housing main flange bolt holes 112 and lower housing main flange bolt holes 116 and securing bolts 130 with nuts 132. Main seal 154 is installed between upper housing main flange 110 and lower housing main flange 114 to prevent the loss of fluid between upper housing main flange 110 and lower housing main flange 114. Lower housing 104 connects to wellhead 16 by inserting bolts 130 (not shown) through bottom flange bolt holes 120 of bottom flange 118 and securing bolts 130 with nuts 132 (not shown).

Upper housing 102 has upper housing internal chamber 127. Lower housing 104 has lower housing internal chamber 129. Piston assembly 125 slides vertically within internal chamber 127. Piston assembly 125 consists of upper shaft 122, upper piston section 124, lower piston section 126, and lower shaft 128. The outer diameter of upper piston section 124 and the outer diameter of lower piston section 126 are approximately equal to the inside diameter of upper housing 102. Piston assembly 125 is sealingly engaged to upper housing internal chamber 127 by piston seals 156 so that hydraulic fluid is unable to pass between piston assembly 125 and upper housing 102. The outside diameter of upper shaft 122 is approximately the same as the inside diameter of top flange 106 and upper shoulder 138. Upper shaft 122 is sealingly engaged to upper shoulder 138 by upper shoulder seals 152 contained in upper shoulder 138 to prevent the loss of fluid from within upper housing 102. The outside diameter of lower shaft 128 is approximately the same as the inside diameter of bottom flange 118 and lower shoulder 140. Lower shaft 128 is sealing engaged to lower shoulder 140 by lower shoulder seals 150 contained in lower shoulder 140 prevent the loss of fluid from within lower housing 104.

Lower shaft 128 has lower shaft downhole end 133. Lower shaft downhole end 133 is threaded for rotatable and fixed engagement with casing, tubing, or drill pipe. Upper shaft 122 may move freely within drilling spool 12 (see FIG. 8). Upper shaft 122 and lower shaft 128 are of unitary construction and together have center channel 131. Center channel 131 of piston assembly 125 allows passage of fluid through CCJ 100. In certain applications, center channel 131 of piston assembly 125 is of sufficient diameter to allow the passage of a drill string having a drill pipe and a drill bit (not shown) through piston assembly 125. When a drill string is passed through center channel 131, the drill string can be operated independently of the CCJ 100. When piston assembly 125 contacts lower shoulder 140 and lower housing 104, movement of piston assembly 125 is stopped and piston assembly 125 is in its lowered position.

Figure 2:
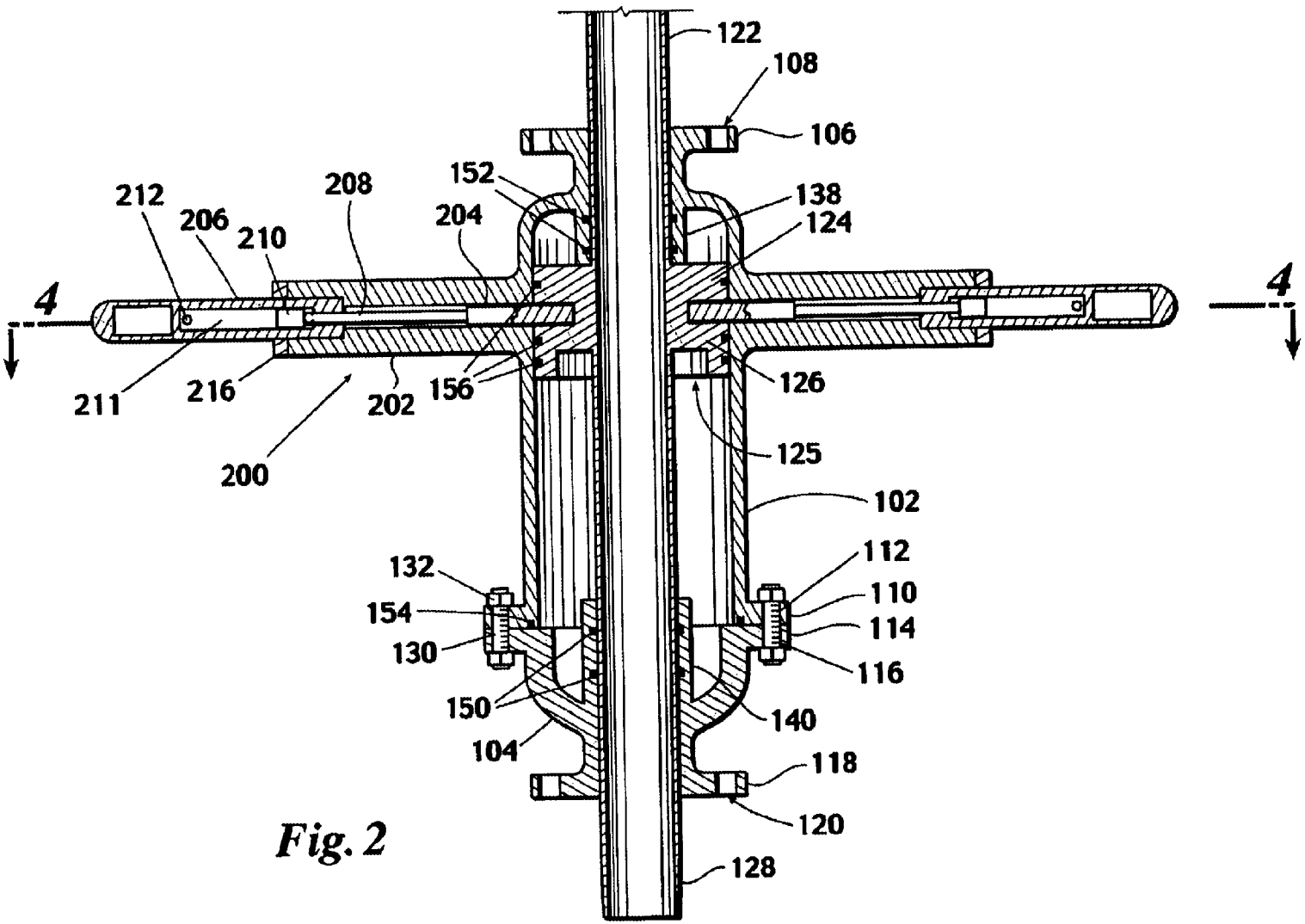
FIG. 2 is a cross-section of the Concentric Casing Jack showing the piston in the raised position and the support plates in the extended position.

Referring to FIG. 2, piston assembly 125 can be raised by pumping hydraulic fluid through lower housing fluid access 136 (see FIG. 5) and into the lower cavity below lower piston section 126, which is defined by lower housing 104, upper housing 102, and lower piston section 126. Hydraulic fluid is simultaneously pumped out of the top cavity above upper piston section 124, which is defined by upper housing 102 and upper piston section 124, through upper housing fluid access 134 (See FIG. 5). The insertion of hydraulic fluid into the lower cavity below lower piston section 126 and the removal of the fluid from the top cavity above upper piston section 124 causes piston assembly 125 to rise. When piston assembly 125 rises sufficiently for upper piston section 124 to contact upper shoulder 138, movement of piston assembly 125 stops and piston assembly 125 is in the raised position. The process of pumping hydraulic fluid under lower piston section 126 and removing hydraulic fluid from above upper piston section 124 can be reversed to lower piston assembly 125 back to the lowered position.

Two identical support assemblies 200 are affixed to opposite sides of upper housing 102. Each support assembly 200 contains a support housing 202, which is joined to upper housing 102 by unitary construction. Support piston housing 206 and support housing cap 216 are fixedly engaged to the outer end of each support housing 202. Support piston 210 slides within support piston internal cavity 211. Hydraulic fluid is pumped into first support fluid access 212 (See FIG. 3) and out of second support fluid access 214 (See FIG. 3) to move support piston 210 towards piston assembly 125 and into the extended position. The process of pumping hydraulic fluid into first support fluid access 212 and out of second support fluid access 214 can be reversed to move support piston 210 away from piston assembly 125 and into the recessed position. Support piston 210 is connected to support plate 204 by piston support shaft 208. Support plate 204 slides along the inside of support housing 202 and is positioned in either the recessed position or the extended position depending on the positioning of support piston 210. When piston assembly 125 is in the raised position, support plate 204 can be moved into the extended position and fits in between upper piston section 124 and lower piston section 126. In the extended position configuration, support plate 204 supports the weight of piston assembly 125 and any casing, tubing, drill pipe, or tools connected onto lower shaft 128. Additionally, with support plate 204 supporting piston assembly 125, it is not necessary to maintain hydraulic fluid pressure in the cavity under lower piston section 126 to keep piston assembly 125 in the raised position.

Figure 3:
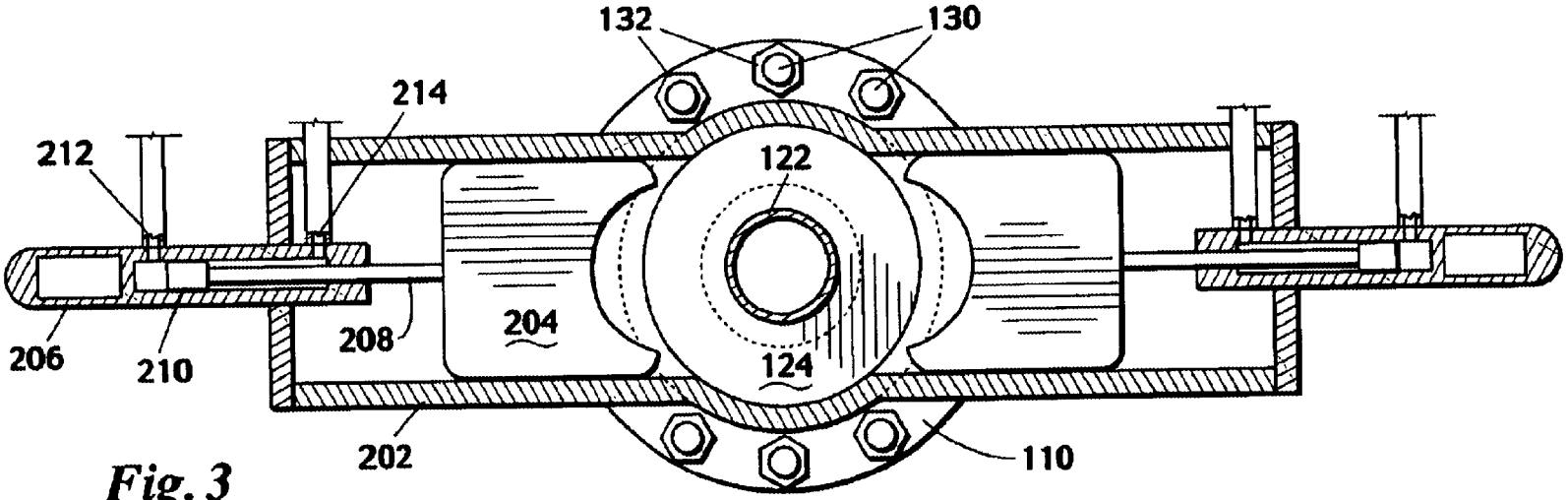
FIG. 3 is a section view of the Concentric Casing Jack taken along line 3—3 in FIG. 1 showing the support plates in the recessed position.

FIG. 3 is a section view of CCJ 100 taken along line 3—3 in FIG. 1 and shows support plates 204 in the recessed position.

Figure 4:
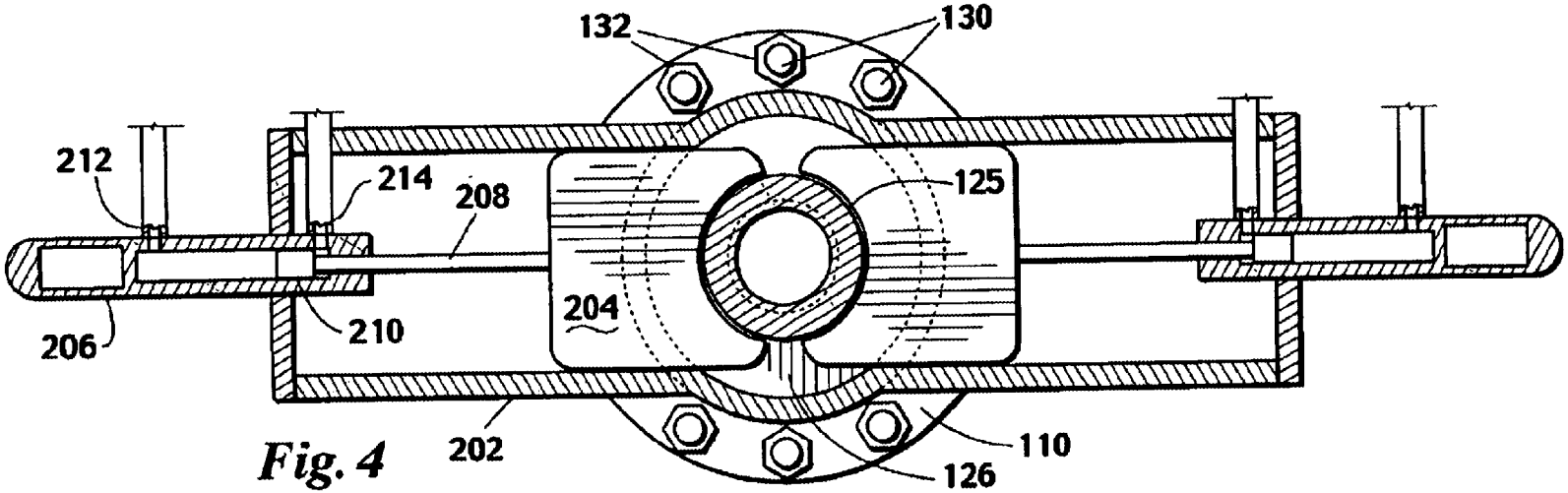
FIG. 4 is a section view of the Concentric Casing Jack taken along line 4—4 in FIG. 2 showing the support plates in the extended position.

FIG. 4 is a section view of CCJ 100 taken along line 4—4 in FIG. 2 showing support plates 204 in the extended position.

Figure 5:
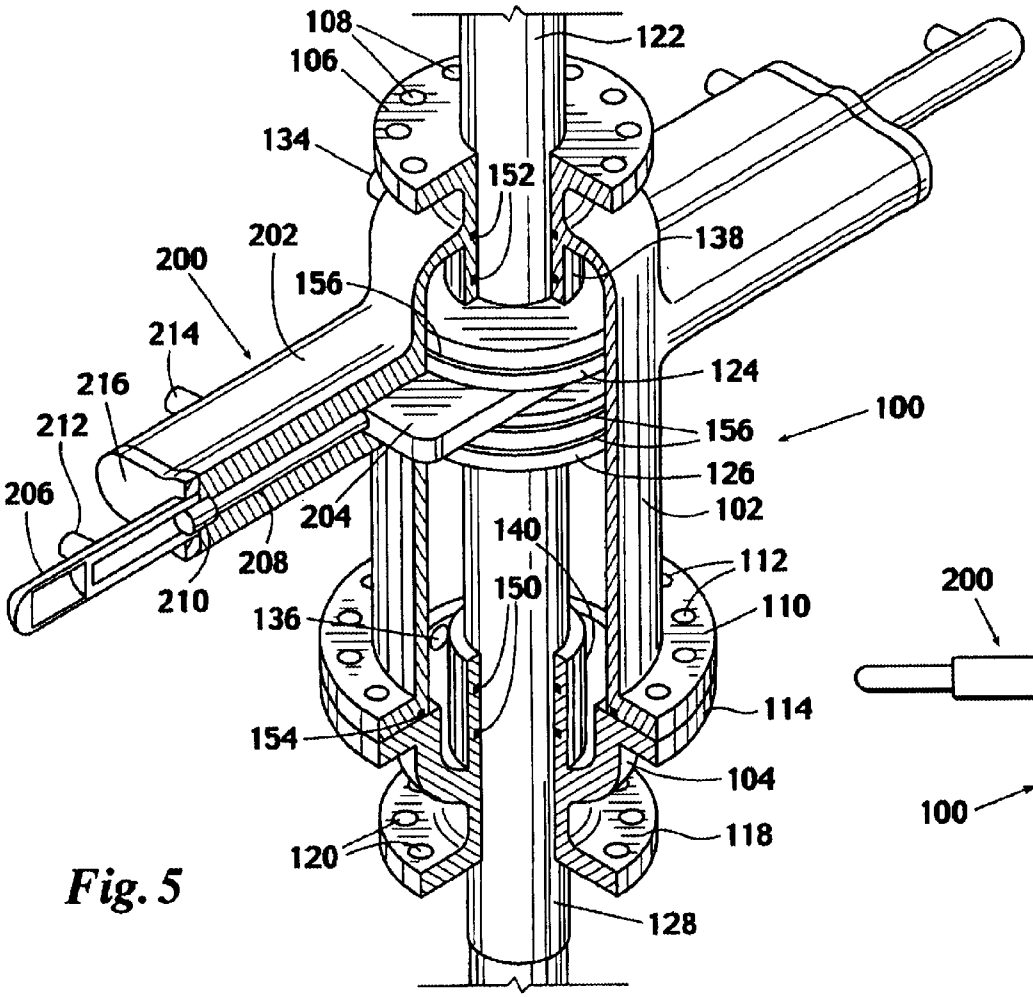
FIG. 5 is a side perspective and partial cutaway of the Concentric Casing Jack showing the piston in the raised position and the support plates in the extended position.

FIG. 5 is a side perspective view and partial cutaway of CCJ 100 showing piston assembly 125 in the raised position with support plate 204 in the extended position between upper piston section 124 and lower piston section 126.

FIG. 6 is a side view of the exterior of CCJ 100.

Figure 7:
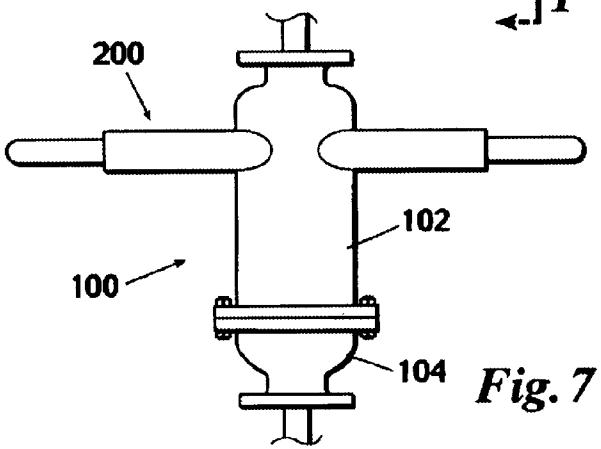
FIG. 7 is a front view of the exterior of the Concentric Casing Jack.
Figure 8:
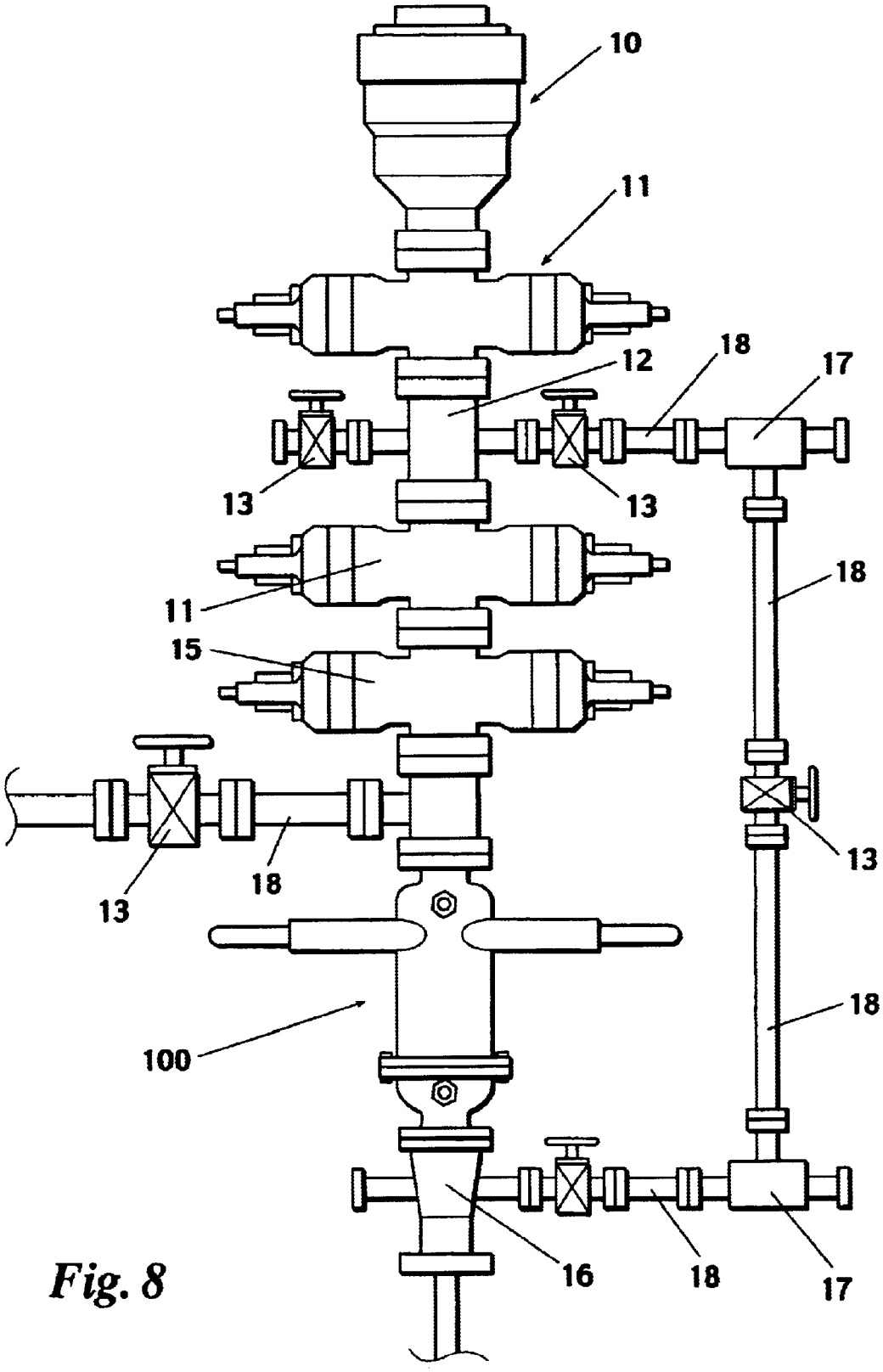
FIG. 8 is a depiction of the Concentric Casing Jack connected in series with other wellhead and safety equipment used in the drilling process.

FIG. 7 is a front view of the exterior of CCJ 100;

FIG. 8 depicts CCJ 100 connected in series with other wellhead and safety equipment used in the drilling process. CCJ 100 is affixed to wellhead 16 and to drilling spool 12. CCJ 100 must be affixed between wellhead 16 and other equipment normally attached to wellhead 16 so that CCJ 100 does not interfere with the operation of the other equipment. In addition, a drilling spool such as drilling spool 12 must be affixed directly above CCJ 100 in order to provide clearance for movement of the concentric casing string in an up and down direction within CCJ 100 and drilling spool 12. In the preferred embodiment the range of up and down movement of the concentric casing string within concentric casing jack and drilling spool is approximately five and one-half inches. Examples of other equipment affixed to wellhead 16 above concentric casing jack 100 are annular blow out preventer 10, pipe ram 11, valves 13, , blind ram 15, pipe "T" 17 and pipe 18.

It will be understood from the foregoing that various modifications and changes may be made in the preferred embodiment of the present invention by those skilled in the art without departing from its true spirit. It is intended that this description is for purposes of illustration only and should not be construed in a limiting sense. The scope of the invention should be limited only by the language of the following claims.

What is claimed is:

1. An apparatus for vertically actuating a string of casing, pipe, or tubing, comprising:

a housing;

a piston assembly positioned within the housing;

wherein the piston assembly comprises:

an upper shaft;

a lower shaft;

at least one support assembly capable of supporting the piston assembly; and wherein the string of casing, pipe, or tubing can be actuated by pumping a fluid into the housing under the piston assembly.

2. The apparatus of claim 1 wherein the housing comprises:

on upper housing; and a lower housing.

3. The apparatus in claim 1 wherein the housing comprises:

an upper shoulder; and a lower shoulder.

4. The apparatus in claim 3 wherein the range of motion of the piston assembly is limited by the upper shoulder and the lower shoulder.

5. The apparatus of claim 1 wherein the piston assembly comprises:

an upper piston section; and a lower piston section.

6. The apparatus of claim 1 wherein the support assembly comprises:

a support plate;

a support piston; and a support shaft connecting the support plate to the support piston.

7. The apparatus in claim 6 wherein the support plate can be positioned to support the piston assembly.

8. An apparatus for vertically actuating a swing of casing, pipe, or tubing, comprising:

an upper housing;

a lower housing positioned below the upper housing;

a piston assembly positioned within the upper housing and the lower housing;

wherein the piston assembly further comprises:

an upper piston section; and a lower piston section positioned below the upper piston section; and wherein the string of casing, pipe, or tubing can be actuated by pumping a fluid into the housing under the piston assembly.

9. The apparatus in claim 8 wherein the housing comprises:

an upper shoulder; and a lower shoulder.

10. The apparatus in claim 9 wherein the range of motion of the piston assembly is limited by the upper shoulder and the lower shoulder.

11. The apparatus of claim 8 wherein the piston assembly further comprises:

an upper shaft; and a lower shaft.

12. The apparatus of claim 8 further comprising at least one support assembly.

13. The apparatus of claim 12 wherein the support assembly comprises:

a support plate;

a support piston; and a support shaft connecting the support plate to the support piston.

14. The apparatus in claim 13 wherein the support plate can be positioned to support the piston assembly.

15. An apparatus for vertically actuating a string of casing, pipe, or tubing, comprising:

a housing;

a piston assembly positioned within the housing;

at least one support assembly capable of supporting the piston assembly;

wherein the piston assembly comprises:

an upper piston section; and a lower piston section positioned below the upper piston section; and wherein the string of casing, pipe, or tubing can be actuated by pumping a fluid into the housing under the piston assembly.

16. The apparatus of claim 15 wherein the housing comprises:

an upper housing; and a lower housing.

17. The apparatus in claim 15 wherein the housing comprises:

an upper shoulder; and a lower shoulder.

18. The apparatus in claim 17 wherein the range of motion of the piston assembly is limited by the upper shoulder and the lower shoulder.

19. The apparatus of claim 15 wherein the piston assembly comprises:

an upper shaft; and a lower shaft.

20. The apparatus of claim 15 wherein the support assembly comprises:

a support plate;

a support piston; and a support shaft connecting the support plate to the support piston.

21. The apparatus in claim 20 wherein the support plate can be positioned to support the piston assembly.

22. A method of actuating a casing suing within a wellbore comprising:

moving a piston assembly disposed within a chamber, supporting the piston assembly with support plates capable of physical interaction with the piston assembly;

wherein the piston assembly comprises:

an upper piston section: and a lower piston section;

operating a tool at the lower end of the casing string by actuating the piston assembly; and wherein the piston assembly is connected to the casing string.

23. The method in claim 22 further comprising operating a tool at the lower end of the casing string by raising the piston assembly.

24. The method in claim 22 further comprising operating a tool at the lower end of the casing string by lowering the piston assembly.

25. The method in claim 22 further comprising pumping a fluid into the chamber, causing the piston assembly to rise.

26. The method in claim 22 further comprising pumping a fluid out of the chamber, causing the piston assembly to fall.

* * * * *

UNITED STATES PATENT AND TRADEMARK OFFICE

CERTIFICATE OF CORRECTION

PATENT NO. : 6,745,842 B2
DATED : July 6, 2004
INVENTOR(S) : Hughes

It is certified that error appears in the above-identified patent and that said Letters Patent is hereby corrected as shown below:

Title page,
Item [73], Assignee, "Corporatioin" should be -- Corporation --

Column 1,
Line 32, "down hole" should be -- down-hole --

Column 2,
Line 5, "hydraulicaly" should be -- hydraulically --

Column 3,
Line 13, "sealing" should be -- sealingly --
Line 15, "140 prevent" should be -- 140 to prevent --

Column 5,
Line 1, "on" should be -- an --
Line 24, "swing" should be -- string --

Column 6,
Line 37, "suing" should be -- string --
Line 44, ":" should be -- ; --

Signed and Sealed this

Tenth Day of August, 2004

JON W. DUDAS
*Acting Director of the United States Patent and Trademark Office*